US009467761B2

(12) United States Patent
Grinker et al.

(10) Patent No.: US 9,467,761 B2
(45) Date of Patent: Oct. 11, 2016

(54) IN-EAR EARPHONE WITH ARTICULATING NOZZLE AND INTEGRATED BOOT

(71) Applicant: Apple Inc., Cupertino, CA (US)

(72) Inventors: Scott C. Grinker, Belmont, CA (US); Glenn K. Trainer, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 161 days.

(21) Appl. No.: 14/318,436

(22) Filed: Jun. 27, 2014

(65) Prior Publication Data

US 2015/0382094 A1 Dec. 31, 2015

(51) Int. Cl.
*H04R 25/00* (2006.01)
*H04R 1/10* (2006.01)

(52) U.S. Cl.
CPC ..... *H04R 1/1016* (2013.01); *H04R 1/1058* (2013.01)

(58) Field of Classification Search
CPC ..... H04R 1/1016; H04R 1/1091
USPC ..... 381/380
See application file for complete search history.

(56) References Cited

U.S. PATENT DOCUMENTS

| | | | | |
|---|---|---|---|---|
| 5,117,461 | A | 5/1992 | Moseley | |
| 6,009,183 | A | 12/1999 | Taenzer et al. | |
| 6,205,227 | B1 | 3/2001 | Mahoney et al. | |
| 8,499,886 | B2 | 8/2013 | Johnston et al. | |
| 8,553,923 | B2 | 10/2013 | Tiscareno | |
| 2007/0071265 | A1 | 3/2007 | Leedom et al. | |
| 2007/0189569 | A1 | 8/2007 | Haapapuro et al. | |
| 2008/0240485 | A1 | 10/2008 | Dyer et al. | |
| 2008/0260196 | A1 | 10/2008 | Tsai | |
| 2009/0202097 | A1* | 8/2009 | Tiscareno | H04R 1/1016 381/380 |
| 2011/0135120 | A1 | 6/2011 | Larsen et al. | |
| 2011/0164777 | A1* | 7/2011 | Takai | H04R 1/1075 381/380 |
| 2012/0039500 | A1* | 2/2012 | Silvestri | H04R 1/1016 381/380 |
| 2012/0219168 | A1 | 8/2012 | Zhao et al. | |
| 2012/0321103 | A1* | 12/2012 | Smailagic | H04R 1/1041 381/98 |

OTHER PUBLICATIONS

"Ultimate Comfort with FlexInear", Phillips Brochure, Feb. 13, 2014, 3 pgs., Version 2.3.8, http://download.p4c.philips.com/files/s/she9900_10/she9900_10_pss_.pdf.

* cited by examiner

*Primary Examiner* — Duc Nguyen
*Assistant Examiner* — Sean H Nguyen
(74) *Attorney, Agent, or Firm* — Blakely, Sokoloff, Taylor & Zafman LLP

(57) ABSTRACT

Intra-canal earphones and methods of manufacturing intra-canal earphones are disclosed. In an embodiment, an intra-canal earphone includes a rigid housing in which a driver is located, a rigid nozzle, and a resilient joint that physically couples the housing with the nozzle and acoustically couples the driver with the nozzle. Other embodiments are also described and claimed.

19 Claims, 7 Drawing Sheets

IN-EAR EARPHONE WITH ARTICULATING NOZZLE AND INTEGRATED BOOT

BACKGROUND

1. Field

Embodiments related to headphones are disclosed. More particularly, an embodiment related to an intra-canal earphone having a rigid housing in which a driver is located, a rigid nozzle, and a resilient joint that physically couples the housing with the nozzle and acoustically couples the driver with the nozzle, is disclosed.

2. Background Information

Intra-canal earphones, also known as in-ear earphones, are headphones that are placed in the ear canal during use. Some intra-canal earphones can seal against the ear canal to isolate the ear canal from the surrounding environment and buffer environmental noise. Sealing between the earphone and the ear canal can be achieved using a custom molded flexible tip. The flexible tip may fill a space between the ear canal and a portion of a tube that is inserted into the ear canal. The tube may include a permanent bend, a custom shape, or may flex along the tube length to provide for an acceptable seal and a comfortable fit within a wide range of ear anatomies. Sound may be delivered through the tube into the ear canal.

SUMMARY

Embodiments of intra-canal earphones are disclosed. In an embodiment, an intra-canal earphone includes a rigid housing and a rigid nozzle pivotally connected by a resilient joint. More particularly, an elastomeric body of the resilient joint may attach to both the housing and the nozzle to join the housing and the nozzle together. The housing may include a chamber that encloses at least a portion of a driver, e.g., a balanced armature transducer, having a driver port. The driver can receive an externally generated electrical audio signal and convert the electrical signal to sound that is emitted from the driver port. A joint channel in the resilient joint may acoustically connect the driver port with a nozzle lumen of the nozzle. Thus, when the earphone is placed in a user's ear, the sound emitted from the driver port may be transmitted through the joint channel and the nozzle lumen into an ear canal.

The resilient joint may include an elastomeric body formed from an elastomeric material, such as a thermoplastic elastomer. Thus, the elastomeric body may flex to allow the nozzle to pivot relative to the housing from an initial state, when an external load is applied to the nozzle, and to return to the initial state, when the external load is removed. For example, when the earphone is inserted into a user's ear, the nozzle may pivot relative to the housing to align with the ear canal, while the housing may remain outside of the ear canal and comfortably fit within a concha of the outer ear.

The resilient joint may fill a space between an inner surface of the housing and a surface of the nozzle. As a result, the resilient joint may be frictionally held by the housing inner surface, and the nozzle may be frictionally held by the resilient joint. The housing and nozzle may include features to enhance retention of the resilient joint therebetween. For example, the housing may include a protrusion extending radially inward from the housing inner surface and the resilient joint may overlay, or cover, the protrusion. As a further example, the nozzle may include one or more nozzle holes extending through a nozzle wall, and the resilient joint may fill the one or more nozzle holes. A wall of the housing or the nozzle may taper, e.g., a nozzle wall may spread outward along a flared portion of the nozzle from the nozzle lumen toward the housing, to resist axial loading applied to the resilient joint. In an embodiment, retention features, such as the one or more nozzle holes, may be located in the tapered or flared portions of housing or nozzle. For example, the one or more nozzle holes in the flared portion may define a rib of the nozzle, and the resilient joint may surround and retain at least a portion of the rib.

The resilient joint may include various receptacles to receive, support, and or seal against other components of the earphone. For example, a driver receptacle in the resilient joint may receive the driver such that a driver outer surface is located within the driver receptacle. Accordingly, the driver may be cantilevered from the driver receptacle into the chamber of the housing. In an embodiment, a portion of the resilient joint, e.g., the elastomeric body of the resilient joint, may seal against the driver outer surface at a proximal end of the joint channel and may seal against the nozzle at a distal end of the joint channel such that the driver port is acoustically coupled with the nozzle lumen through the joint channel. Furthermore, the elastomeric body may fill a space between an inner surface of the housing and an outer surface of the driver axially between the driver port and the chamber such that the driver port is acoustically isolated from the chamber.

The intra-canal earphone may also include a compliant tip having a tip lumen that is acoustically coupled with the driver port through the nozzle lumen. The intra-canal earphone may be of the sealed-type earphone, and thus, an outer surface of the tip may be configured to seal against an ear canal. Accordingly, the externally generated audio signal may be transmitted from a portable media player through an audio jack and a cable to the driver and the driver may play sound through the nozzle lumen and the tip lumen into the user's ear canal.

Numerous methods may be used to build an intra-canal earphone. In an embodiment, a method includes forming a rigid housing having a chamber and forming a rigid nozzle having a nozzle lumen. The method may also include molding a resilient joint having an elastomeric body and a joint channel over at least a portion of the pre-formed housing and nozzle. Thus, the nozzle may become pivotally coupled with the housing through the overmolded elastomeric body. Furthermore, the nozzle lumen may be acoustically coupled with the chamber through the joint channel. A driver receptacle may be formed in the resilient joint, and the driver receptacle may be in fluid communication with the joint channel. Accordingly, a driver may be installed in the driver receptacle such that a driver port becomes acoustically coupled with the nozzle lumen through the joint channel. By contrast, the overmolded elastomeric body may fill a portion of the chamber between an inner surface of the housing and an outer surface of the driver between the driver port and the chamber such that the driver port is acoustically isolated from the chamber. In an embodiment, a compliant tip may be disposed over an outer surface of the nozzle such that a tip lumen is acoustically coupled with the driver port through the nozzle lumen. Furthermore, an outer surface of the tip may be configured to seal against an ear canal to deliver sound from the driver port through the nozzle lumen and tip lumen into the ear canal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
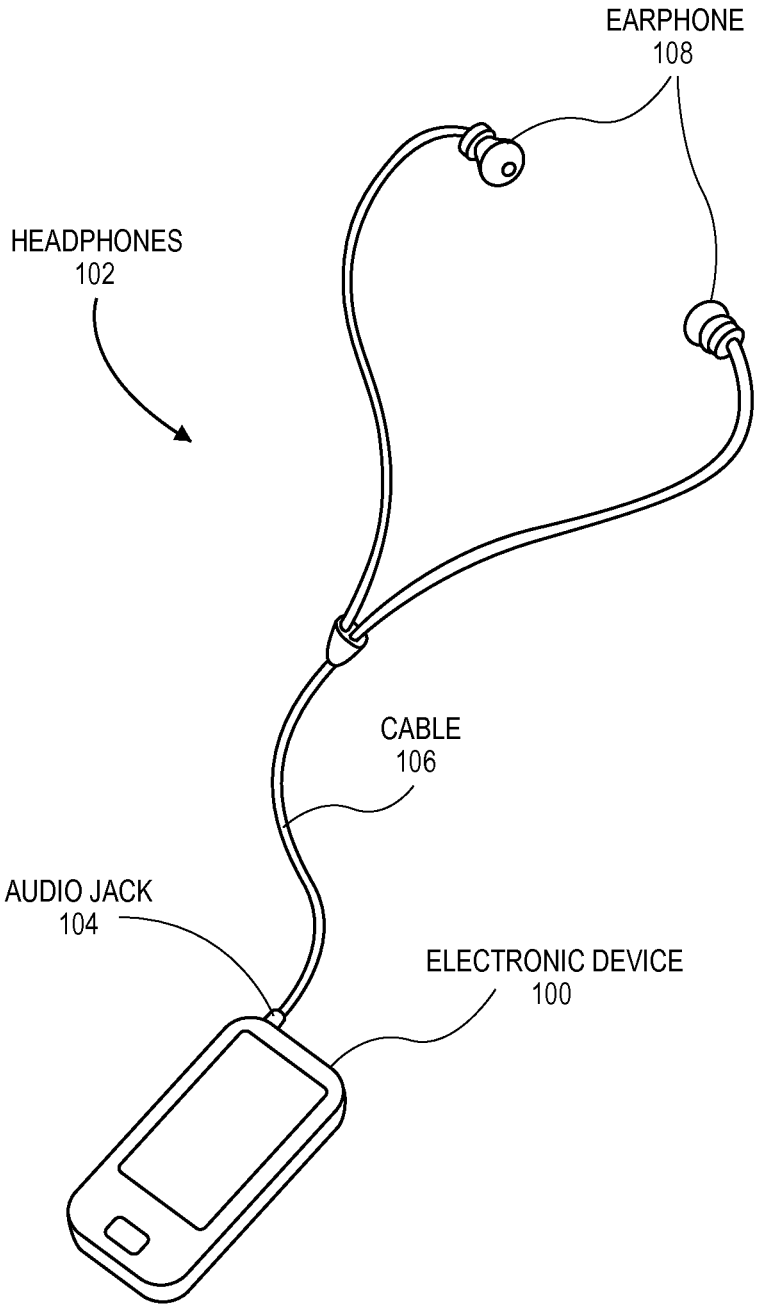
FIG. 1 is a perspective view of a portable media player connected with headphones in accordance with an embodiment of the invention.

Embodiments of the invention describe headphones for use in playing externally generated audio signals received from an external audio source. However, while some embodiments are described with specific regard to intra-canal earphones, the embodiments are not so limited, and certain embodiments may also be applicable to other uses. For example, one or more of the embodiments described below may be integrated within other devices or apparatuses that direct sound into the ear, such as intra-concha earphones that fit loosely in the outer ear, or hearing aids.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment", or the like, means that a particular feature, structure, configuration, or characteristic described is included in at least one embodiment. Thus, the appearance of the phrase "one embodiment," "an embodiment", or the like, in various places throughout this specification are not necessarily referring to the same embodiment. Furthermore, the particular features, structures, configurations, or characteristics may be combined in any suitable manner in one or more embodiments.

In an aspect, an embodiment of an intra-canal earphone includes a rigid housing, a rigid nozzle, and a resilient joint that pivotally couples the housing with the nozzle. For example, the resilient joint may include an elastomeric body that joins the housing with the nozzle and flexes to allow the nozzle to articulate relative to the housing when the earphone is inserted into an ear canal. Thus, the nozzle and housing may pivot relative to one another from an initial state to fit comfortably within the anatomy of a variety of ear anatomies, and may recover to the initial state after being removed from the ear canal.

In an aspect, an embodiment of the intra-canal earphone includes a resilient joint having a joint channel that acoustically couples a driver located in a housing with a nozzle lumen of a nozzle. The resilient joint may seal around the driver at a proximal end of the joint channel and may seal around the nozzle at a distal end of the joint channel such that sound emitted by the driver is transmitted through the joint channel into the nozzle lumen. The resilient joint may fill a space between the housing and the driver to acoustically isolate a housing chamber from the sound emitted by the driver. Thus, the resilient joint may provide an integrated boot to direct sound through the nozzle and reduce the likelihood of sound leaking into the chamber.

In an aspect, the resilient joint may include a driver receptacle to receive the driver and support the driver within the chamber. That is, the resilient joint may hold the driver and be located between the driver, the housing, and the nozzle such that the elastomeric body of the resilient joint absorbs mechanical shock transmitted through the housing or the nozzle. Thus, in the event that the intra-canal earphone impacts an external object, e.g., when the earphone is accidentally dropped to the ground, the elastomeric body may absorb the shock and protect the driver from damage.

In an aspect, the resilient joint may fill voids or spaces between the housing, the nozzle, and the driver, such that the resilient joint is frictionally fit between the earphone components. For example, the resilient joint may overlay a portion of the housing and the nozzle, as in the case where the resilient joint comprises a thermoplastic elastomer that is overmolded directly between the housing and the nozzle. Furthermore, the driver may fill the driver receptacle in the resilient joint. Thus, empty space between components of the earphone may be minimized to create a compact earphone assembly. More specifically, an intra-canal earphone having a rigid housing pivotally coupled with a rigid nozzle by an intermediate resilient joint may minimize tolerance stack-ups and reduce earphone size.

FIG. 1 is a perspective view of a portable media player connected with headphones in accordance with an embodiment of the invention. An electronic device 100, such as a portable media player or another device capable of playing audio, video, or other media, may be connected to an external speaker system, such as a pair of headphones 102. For example, the headphones 102 may include an audio jack 104 or other electrical connector that electrically connects the electronic device 100 with a headphones cable 106. That is, the cable 106 may receive an electrical signal from the electronic device 100 through the audio jack 104. Thus, an electrical audio signal may be externally generated by the electronic device 100 and transmitted through the audio jack 104 and the cable 106 toward one or more earphones 108. In an alternative embodiment, the headphones 102 incorporate a wireless interface to receive the externally generated audio signal via a wireless connection with an external amplifier. Other embodiments may include an earphone incorporated in a hearing aid, but by way of contrast, a hearing aid produces an electrical audio signal from a built-in pickup and then converts the electrical signal to sound waves, rather than receiving an externally generated signal from an electronic device 100.

Figure 2:
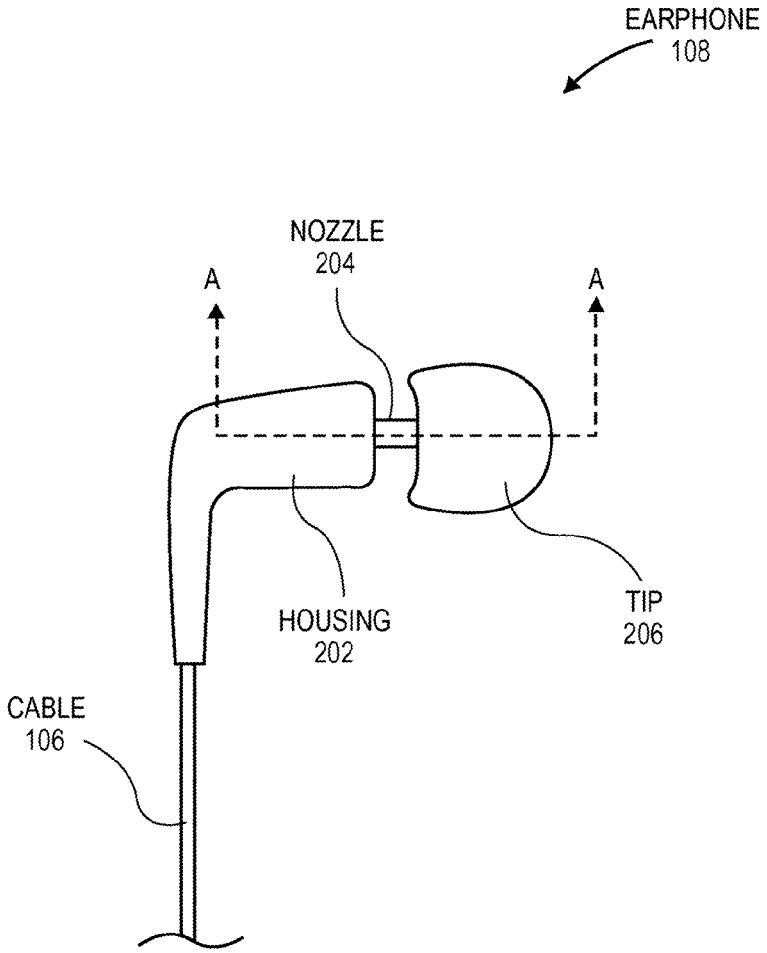
FIG. 2 is a side view of an intra-canal earphone in accordance with an embodiment of the invention.

Turning now to FIG. 2, a side view of an intra-canal earphone is shown in accordance with an embodiment of the invention. An assembled earphone 108 may include several components. More particularly, earphone 108 may include a housing 202 connected with cable 106. Housing 202 may be physically connected to a nozzle 204 that extends distally away from housing 202. For example, housing 202 may be pivotally connected to nozzle 204 by a joint, such as a resilient joint, that may be located at the housing 202 itself. That is, the resilient joint may be located between housing 202 and nozzle 204, rather than being located along the nozzle 204 length, i.e., at a location between a proximal and distal end of the nozzle 204. Earphone 108 may also include a tip 206 disposed over nozzle 204. For example, tip 206 may surround a distal end of nozzle 204 and be distally spaced apart from housing 202 along nozzle 204. During use, tip 206 may be placed into an ear canal, while housing 202 may at least partially reside in a concha of the ear. Thus, during use, nozzle 204 may traverse a distance between a housing 202 located outside of the ear canal and a tip 206 located inside of the ear canal.

Figure 3:
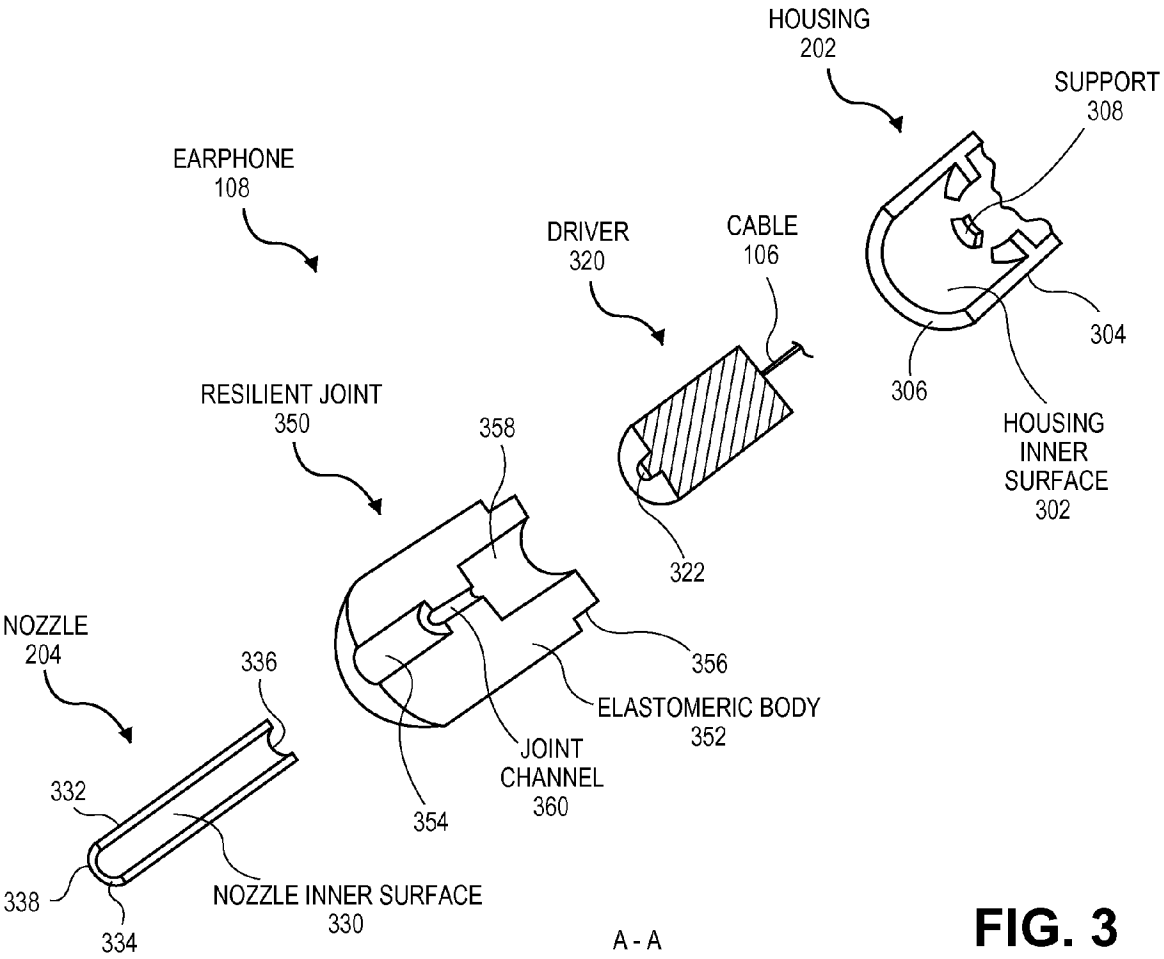
FIG. 3 is an exploded cross-sectional view, taken about line A-A of FIG. 2, of an intra-canal earphone in accordance with an embodiment of the invention.

FIG. 3 is an exploded cross-sectional view, taken about line A-A of FIG. 2, of an intra-canal earphone in accordance with an embodiment of the invention. In an embodiment, housing 202 includes a shell structure having one or more components that may be integrally formed or assembled. For example, housing 202 may include two halves that are bonded together to form a whole. The assembled housing 202 may include a housing inner surface 302 separated from a housing outer surface 304 by a housing wall 306. A space within housing inner surface 302 may define a chamber of the assembled earphone 108, as will be described further below. Furthermore, housing 202 may include one or more features, such as one or more ribbed supports 308 protruding in a radially inward direction from housing inner surface 302. Housing outer surface 304 may provide a grip for a user to handle during insertion or removal of earphone 108 in an ear canal. Housing inner surface 302 and/or one or more supports 308 may hold a driver 320, or may limit movement of a driver 320 during use, as will be explained further below.

In an embodiment, housing 202 may be rigid. That is, housing 202 may have sufficient stiffness to resist deformation under loading typically experienced during headphone use, such as due to sound waves produced by driver 320 or physical loads applied to housing 202 during handling. The rigidity of the housing 202 may also be described in terms of the material, or the typical elastic modulus of the material, used to form housing 202. For example, housing 202 may be formed from polymers including high-density polyethylene or polycarbonate. Accordingly, housing 202 material may have an elastic modulus in the range of 0.5 to 20 GPa, by way of example only. For example, housing 202 material may have an elastic modulus in the range of 0.5 GPa to 2.5 GPa. However, many other rigid materials having corresponding elastic moduli may be used to form housing 202, including metals and ceramics.

In an embodiment, driver 320 may be located within a chamber of the assembled earphone 108, and more particularly, may be at least partially disposed radially inward from housing inner surface 302. Driver 320 may include one of various known transducers used to receive the externally generated audio signal from cable 106 and to convert the signal into sound. For example, driver 320 may include a balanced armature, moving-coil, electrostatic, electret, or thermoacoustic transducer. In an embodiment, driver 320 includes a balanced armature transducer that drives a diaphragm to generate sound. Driver 320 may emit the sound from a driver port 322 in a distal direction away from the housing chamber.

In an embodiment, nozzle 204 includes a shell structure having one or more components that may be integrally formed or assembled. For example, nozzle 204 may be injection molded as a single part having a nozzle inner surface 330 separated from a nozzle outer surface 332 by a nozzle wall 334. A space within nozzle inner surface 330 may define a nozzle lumen of the assembled earphone 108, as will be described further below. The nozzle lumen may extend between a nozzle proximal end 336 and a nozzle distal end 338 to provide an acoustic channel for sound emitted by driver 320 to emanate from earphone 108.

In an embodiment, nozzle 204 may be rigid. That is, nozzle 204 may have sufficient stiffness to resist deformation under loading typically experienced during headphone use, such as due to sound waves produced by driver 320 or physical loads applied to nozzle 204 during insertion of earphone 108 into an ear canal. The rigidity of the nozzle 204 may also be described in terms of the material, or the typical elastic modulus of the material, used to form nozzle 204. For example, nozzle 204 may be formed from polymers including high-density polyethylene or polycarbonate. Accordingly, nozzle 204 material may have an elastic modulus in the range of 0.5 to 20 GPa, by way of example only. For example, housing 202 material may have an elastic modulus in the range of 0.5 GPa to 2.5 GPa. However, many other rigid materials having corresponding elastic moduli may be used to form nozzle 204, including metals or ceramics.

Resilient joint 350 may be installed, injected, or otherwise disposed between nozzle 204 and housing 202 so as to form a joint that physically couples nozzle 204 with housing 202. For example, resilient joint 350 may include an elastomeric body 352 having a nozzle receptacle 354 that conforms to at least a portion of nozzle 204. For example, nozzle receptacle 354 may include a counterbore, in elastomeric body 352, which is sized and configured to receive nozzle 204. The nozzle receptacle 354 may be distal from a housing receptacle 356 that conforms to at least a portion of housing 202. For example, housing receptacle 356 may include a boss, extending from elastomeric body 352, which is sized and configured to fit into a distal opening of housing inner surface 302. Thus, it will be appreciated that one or more receptacles of resilient joint 350 may be sized and configured to receive another earphone component, or to be received by, e.g., to fit into, another earphone component. Furthermore, the structure of resilient joint 350 is not intended to be limited to prefabricated features that are then assembled with other components, but rather, resilient joint 350 may be integrally formed with the other components. For example, resilient joint 350 may be overmolded on or around nozzle 204 and housing 202 to result in a uniform whole made of several components having varying respective rigidities.

Resilient joint 350 may also include a driver receptacle 358 that conforms to at least a portion of driver 320. For example, driver receptacle 358 may include a counterbore in elastomeric body 352 that is sized and configured to receive driver 320. Driver receptacle 358 may receive driver 320 loosely, or in an embodiment, driver receptacle 358 may physically support driver 320, e.g., a distal portion of driver 320 may be located in driver receptacle 358 and a proximal portion of driver 320 may cantilever away from driver receptacle 358.

In an embodiment, resilient joint 350 may be installed, injected, or otherwise disposed between nozzle 204 and driver 320 so as to acoustically couple driver port 322 with a nozzle lumen within nozzle inner surface 330. For example, a joint channel 360 may be formed through elastomeric body 352 between driver receptacle 358 and nozzle receptacle 354. Thus, driver port 322, which may be disposed in driver receptacle 358, may emit sound distally through joint channel 360 and into the nozzle lumen. The sound may propagate toward nozzle distal end 338 and outward away from earphone 108.

At least a portion of resilient joint 350 may be compliant or resilient. For example, a portion of resilient joint 350 may exhibit one or both of elasticity or viscosity. In an embodiment, forming the compliant portion of resilient joint 350 from a viscoelastic material may be beneficial to shock performance, as the material can lose energy when a load or impact is applied. However, in other embodiments, chemical resistance requirements may supersede the requirement for shock performance, and the compliant portion of resilient joint 350 may include a material with elastic and chemical resistance properties, but with limited or no viscous properties. In an embodiment, the compliant portion of resilient joint 350 may be elastomeric body 352, which may be elastomeric. That is, elastomeric body 352 may include an elastomer, e.g., silicone, having elasticity and/or some viscosity, such that the assembled components of earphone 108 may exhibit freedom of movement relative to one another. For example, when housing receptacle 356 is engaged with housing inner surface 302 and nozzle receptacle 354 is engaged with nozzle outer surface 332, nozzle 204 may be pivoted relative to housing 202 from an initial state. Such articulation may occur, for example, when nozzle 204 is inserted into an ear canal while housing 202 remains in the concha of the ear. The articulation may be expressed in terms of a pivot angle that an axis passing through nozzle 204 subtends when it is flexed from an initial orientation. For example, a nozzle axis may be parallel to an axis passing through a chamber in the initial orientation. However, in a pivoted orientation, the nozzle axis may subtend an angle relative to the chamber axis to align with an ear canal. For example, the elastic body 352 may incorporate a material that has sufficient flexibility to allow the subtended angle to be at least about 5 to 10 degrees. Furthermore, the elastomeric body 352 may be elastomeric such that, when the nozzle 204 is removed from the ear canal, the nozzle may pivot back to the initial orientation. Numerous materials having elastomeric characteristics may be used to form elastomeric body 352, which may form all or part of the mass of resilient joint 350. For example, elastomeric body 352 may include unsaturated rubbers or saturated rubbers. Elastomeric body may include silicone. In an embodiment, elastomeric body 352 may include thermoplastic elastomers, which are suited to injection molding. Thus, elastomeric body 352 may be injected on or around nozzle 204 and housing 202 in an overmolding process. Suitable thermoplastic elastomers include styrenic block copolymers, polyolefin blends, elastomeric alloys, thermoplastic polyurethanes, thermoplastic copolyester, and thermoplastic polyamides. In terms of hardness, elastomeric body 352 may incorporate a material having a durometer of between about 5-70 on the Shore A scale. For example, a durometer of elastomeric body 352 may be between about 20-60 on the Shore A scale. Elastomeric body 352 may also include a stiffness. More particularly, both the durometer and geometry of elastomeric body 352 may affect the overall system stiffness, which may be described in terms of the force required to displace nozzle 204 relative to housing 202. In an embodiment, a transverse load on nozzle 204 of about 0.25 to 1.0 N may result in articulation between nozzle 204 and housing 202 of between about 5 to 10 degrees.

In an embodiment, only a portion of resilient joint 350 may be elastomeric. That is, elastomeric body 352 may form only a portion of resilient joint 350. For example, resilient joint 350 may have a shell and core structure, in which the core comprises elastomeric body 352, and elastomeric body 352 is surrounded by an outer shell. For example, an outer 1 to 5 mm thickness of resilient joint 350 may be occupied by the shell, and the shell may be formed from a same or different material as elastomeric body 352. The shell may be coated, overmolded, or otherwise disposed over elastomeric body 352. Alternatively, an outer portion of resilient joint 350 may be treated, e.g., cross-linked or heat-treated, to create a resilient joint 350 formed from a material that varies in hardness across its volume. The outer shell may be more rigid than elastomeric body 352. For example, the outer shell may include a rigid polymer, metal, or ceramic. In another embodiment, the outer shell may be more flexible than the core, and thus, the flexibility of resilient joint may be at least partially due to the outer shell, i.e., the shell may be elastomeric and the core may be rigid. Such a layered structure may be advantageous in that the layers may be tuned to fit their purpose in earphone. For example, an outer layer may be made from a material that is more easily bonded to the material used to form housing 202 or nozzle 204, while the inner core may be formed from a material that provides flexibility to pivotally couple housing 202 with nozzle 204, and allow articulation therebetween.

Figure 4:
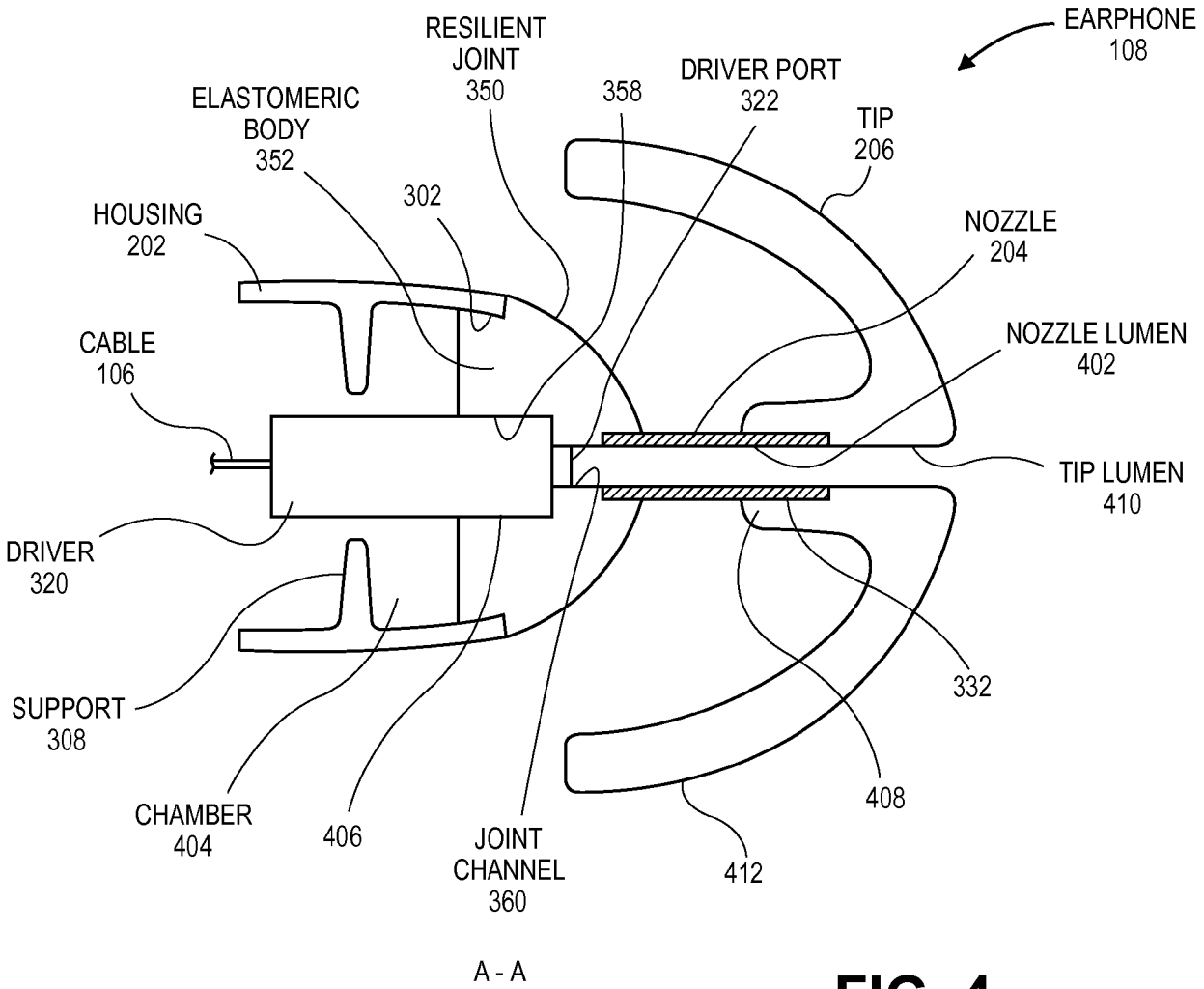
FIG. 4 is a cross-sectional view, taken about line A-A of FIG. 2, of an intra-canal earphone having a resilient joint between a housing and a nozzle in accordance with an embodiment of the invention.

FIG. 4 is a cross-sectional view, taken about line A-A of FIG. 2, of an intra-canal earphone having a resilient joint between a housing and a nozzle in accordance with an embodiment of the invention. In an embodiment, elastomeric body 352 forms an entire mass of resilient joint 350 and is attached to housing 202 at housing inner surface 302. For example, a proximally extending boss of elastomeric body 352, e.g., housing receptacle 356, may be inserted into a distal opening of housing 202 to form a press fit against housing inner surface 302. Furthermore, elastomeric body 352 may be attached to nozzle 204, e.g., at nozzle outer surface 332. For example, a proximal portion of nozzle 204 may be inserted into a counterbore in a distal face of elastomeric body 352, e.g., nozzle receptacle 354. Thus, the elastomeric body 352 may fill a gap between the housing inner surface 302 and the nozzle 204, and may apply friction at the mating surfaces to frictionally hold housing 202, resilient joint 350, and nozzle 204, together. Alternatively or additionally, an adhesive, e.g., acrylic resin, may be applied to the mating surfaces to further enhance the attachment between one or more of housing 202, resilient joint 350, or nozzle 204.

In the assembled earphone 108, a nozzle lumen 402 within nozzle inner surface 330 may be acoustically coupled with driver port 322. A counterbore in a proximal face of resilient joint 350 may form driver receptacle 358. Prior to integration of driver 320 into earphone 108, the counterbore may be acoustically coupled with nozzle lumen 402 through joint channel 360. That is, driver receptacle 358, joint channel 360, and nozzle lumen 402 may be coaxially aligned such that nozzle lumen 402 is in fluid communication with a chamber 404 within housing inner surface 302. During assembly of earphone 108, driver 320 may be installed in driver receptacle 358 such that driver port 322 is coaxially aligned with joint channel 360. Thus, driver port 322 may be acoustically coupled with nozzle lumen 402, since sound emitted from driver port 322 can propagate distally toward nozzle distal end 338 through joint channel 360 and nozzle lumen 402.

In an embodiment, acoustic coupling of driver port 322 and nozzle lumen 402 may be further enhanced by providing a seal between resilient joint 350 and at least some portion of driver 320 to promote propagation of sound through joint channel 360 toward nozzle lumen 402. A driver outer surface 406 may extend to a distal end of driver 320. For example, driver 320 may have a cylindrical profile with a diametric surface defining driver outer surface 406. Furthermore, driver 320 may have a cylindrical boss extending from a larger cylindrical body, i.e., a stepped cylindrical surface, and driver port 322 may be located at a distal end of the cylindrical boss. In such case, driver outer surface 406 may also extend over the diametrical surface defining the cylindrical boss. However, in other cases, driver 320 may have a variety of shapes, and thus, driver outer surface 406 may be any transversely located surface along a length of driver 320.

When driver 320 is disposed within driver receptacle 358, at least a portion of an inward surface of resilient joint 350 may press and/or seal against a portion of driver outer surface 406. For example, an inner surface of a counterbore forming driver receptacle 358 may form a press fit around the larger cylindrical body of driver 320. Alternatively, an inner surface of joint channel 360 through resilient joint 350 may form a press fit around the cylindrical boss of driver 320. The seal between resilient joint 350 and driver 320 may be formed proximal to driver port 322, i.e., in a direction opposite to the direction of sound emission from driver port 322. Furthermore, an inner surface defining joint channel 360 may seal against nozzle proximal end 336, such that joint channel 360 spans a distance between and seals against driver 320 and nozzle 204. Accordingly, substantially all of the sound emitted from driver port 322 can propagate through joint channel 360 into nozzle lumen 402.

Sealing between components may be created by pressure between component surfaces, as described above. Sealing may also be enhanced by additional components. For example, a gasket, such as an O-ring, may be located between resilient joint 350 and driver 320 or nozzle 204 to create a hermetic and/or acoustic seal between those components. Similarly, an adhesive or a lubricant film may be located between components, e.g., between resilient joint 350 and driver 320 or nozzle 204, to create an acoustic seal between those components.

Acoustic coupling between driver port 322 and nozzle lumen 402 may be enhanced by preventing sound leakage from driver port 322 into chamber 404. Resilient joint 350 may seal against a portion of driver outer surface 406 between driver port 322 and chamber 404, e.g., proximal to driver port 322. More particularly, resilient joint 350 may fill a space between housing inner surface 302 and the driver outer surface 406 such that sound emitted from driver port 322 is less likely to propagate along driver outer surface 406 into chamber 404. In an embodiment, sealing may be over a substantial length of driver outer surface 406, e.g., at least about one third of the driver 320 length. However, in another embodiment, sealing may be over a lesser length of a distal portion of driver 320 that is directly adjacent to driver port 322, e.g., over the cylindrical boss surrounding driver port 322 (see FIG. 5). In any case, driver port 322 and chamber 404 may be acoustically isolated. Furthermore, since making a seal between resilient joint 350 and driver 320 makes sound leakage toward chamber 404 less likely, sound may propagate toward nozzle lumen 402, enhancing acoustic coupling between driver port 322 and nozzle lumen 402.

Driver 320 may be supported in chamber 404 in several ways. In an embodiment, driver 320 may be cantilevered from resilient joint 350. That is, a distal portion of driver 320, such as driver outer surface 406 surrounding driver port 322 and/or driver outer surface 406 proximal from driver port 322 may fit within driver receptacle 358 such that resilient joint 350 grips and holds driver 320. Thus, a proximal portion of driver 320, such as a proximal end that receives cable 106, may be freely supported within chamber 404.

Whereas resilient joint 350 may exhibit some degree of compliance and flexibility due to elastomeric body 352, a cantilevered driver 320 may experience some pivoting or lateral motion within chamber 404 during use. In an embodiment, one or more supports 308 extend inward from housing inner surface 302, effectively reducing the minimum diameter of housing inner surface 302. As a result, support 308 may limit lateral movement of driver 320 because as the driver pivots within chamber 404, it may contact support 308, which can prevent further lateral motion. The geometry of support 308 may be altered as required to distribute pressure applied to driver outer surface 406 when driver 320 contacts support 308. That is, support 308 may make a point contact or include an axial ribbing to make contact over an axial length of driver 320. The geometry of support 308 may also be altered as required to provide for more or less lateral movement of driver 320. For example, in an embodiment, support 308 may contact driver 320 in all configurations, i.e., even in an initial state, such that support 308 forms a cradle that holds a portion of driver 320 within chamber 404 (see FIG. 5). Support 308 may be rigid or flexible, e.g., elastomeric. Accordingly, support 308 may be injection molded in a same shot with housing 202, or may be separately formed as a compliant support 308 that is overmolded or bonded on housing inner surface 302. Thus, support 308 may absorb shock between housing 202 and driver 320 in the event of an impact on the housing.

A compliant tip 206 may be disposed on nozzle 204 to acoustically couple the nozzle with a user's ear. For example, a tip hub 408 may include a counterbore in a proximal end of tip 206 that is sized and configured to receive nozzle 204, e.g., to form a press fit against nozzle outer surface 332. Tip 206 may include a tip lumen 410 that can be axially aligned with nozzle lumen 402 in the assembled earphone 108. Thus, tip lumen 410 may be acoustically coupled with nozzle lumen 402. Accordingly, sound emitted by driver port 322 may propagate through joint channel 360 and nozzle lumen 402 into tip lumen 410. Furthermore, since tip lumen 410 may extend from a proximal end to a distal end of tip 206, sound may be emitted into an ear canal from the tip when it is located within a user's ear.

Acoustic coupling between nozzle lumen 402 and the ear canal may be further enhanced by forming a seal against the ear canal. That is, earphone 108 may be a sealed-type earphone 108. Tip outer surface 412 may have a diameter that is larger than a diameter of the ear canal at the desired sealing location. Furthermore, to facilitate sealing as well as comfort, tip 206 may be formed from a compliant or flexible material. For example, tip 206 may be formed from a foam, an elastomer, or another soft and resilient material that flexes inwardly when pressed into the ear canal, but also applies a resilient outward force to form a seal against the ear canal.

Figure 5:
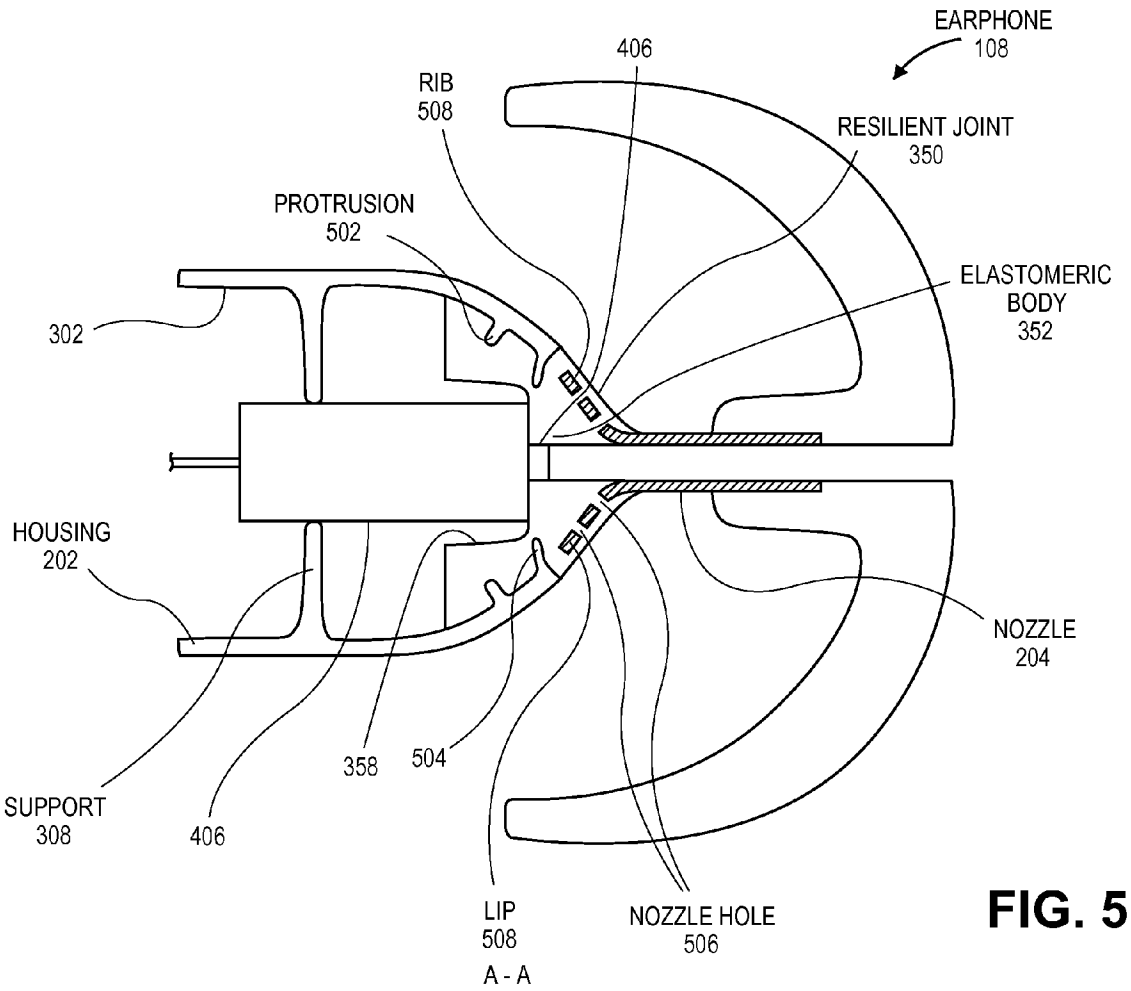
FIG. 5 is a cross-sectional view, taken about line A-A of FIG. 2, of an intra-canal earphone having a resilient joint between a housing and a nozzle in accordance with another embodiment of the invention.

FIG. 5 is a cross-sectional view, taken about line A-A of FIG. 2, of an intra-canal earphone having a resilient joint between a housing and a nozzle in accordance with another embodiment of the invention. In addition to relying on friction fits or adhesive bonding between flat surfaces to maintain housing 202, resilient joint 350, and nozzle 204 in an assembled state, each of the components may include retention features to enhance physical coupling. For example, housing 202 or nozzle 204 may include tapered surfaces that slope at least partially in a radial direction such that axial loading on resilient joint 350 is resisted. As shown in FIG. 5, a distal region of housing inner surface 302 may taper radially inward toward nozzle 204, creating a sloped surface that engages with a mating surface of resilient joint 350. Relative movement between housing 202 and resilient joint 350 may be resisted by the contacting surfaces, because any distal loading on resilient joint 350, e.g., transmitted through nozzle 204, may be resisted by a proximal reaction load applied to resilient joint 350 by the tapered surface of housing 202. Similar surface contours, such as waves, undulations, spiraled threads, etc., may similarly resist movement of resilient joint 350 relative to housing 202 or nozzle 204.

In an embodiment, retention features on nozzle 204 or housing 202 may include projections extending from a surface that contacts resilient joint 350. For example, housing 202 may include one or more protrusions 502 extending radially inward from housing inner surface 302 to facilitate bonding between housing 202 and resilient joint 350. Protrusion 502 may be a nub, bulge, projection, spike, or any other feature having a height and width dimension such that when resilient joint 350 overlays protrusion 502, a retaining force is applied to resilient joint 350 by protrusion 502 to resist removal of resilient joint 350 from housing 202.

Other retention features may be added to housing 202 or nozzle 204 to retain resilient joint 350. For example, a lip 504 may be formed along a portion of a distal opening of housing 202. Like protrusion 502, lip 504 may be inwardly directed in one embodiment. However, lip 504 may also project outward from housing 202 in an embodiment in which resilient joint 350 extends around an outer surface of housing 202. Accordingly, lip 504 may have a height and width dimension such that when resilient joint 350 overlays lip 504, a retaining force is applied to resilient joint 350 by lip 504 to resist removal from housing 202.

Nozzle 204 and housing 202 may also include retention features that may be filled, encapsulated, or surrounded by resilient joint 350 to enhance physical coupling. For example, resilient joint 350 may be overmolded on or around a retention feature to capture and retain nozzle 204 or housing 202. In an embodiment, nozzle 204 includes one or more nozzle holes 506 formed through nozzle wall 334. The nozzle holes 506 may extend circumferentially, e.g., around a flared proximal portion of nozzle 204, such that one or more ribs 508 is defined between the nozzle holes 506. Resilient joint 350 may fill at least one of the nozzle holes 506 and/or surround at least a portion of one of the ribs 508. Thus, if a dislodgement force is applied to nozzle 204, resilient joint 350 may retain nozzle 204 relative to housing 202 because resilient joint 350 may also be attached to housing 202 via a friction fit, adhesive bond, or other attachment mechanism. Thus, distal loading on nozzle 204 may be resisted by a proximal reaction load applied to resilient joint 350 by housing 202.

Figure 6:
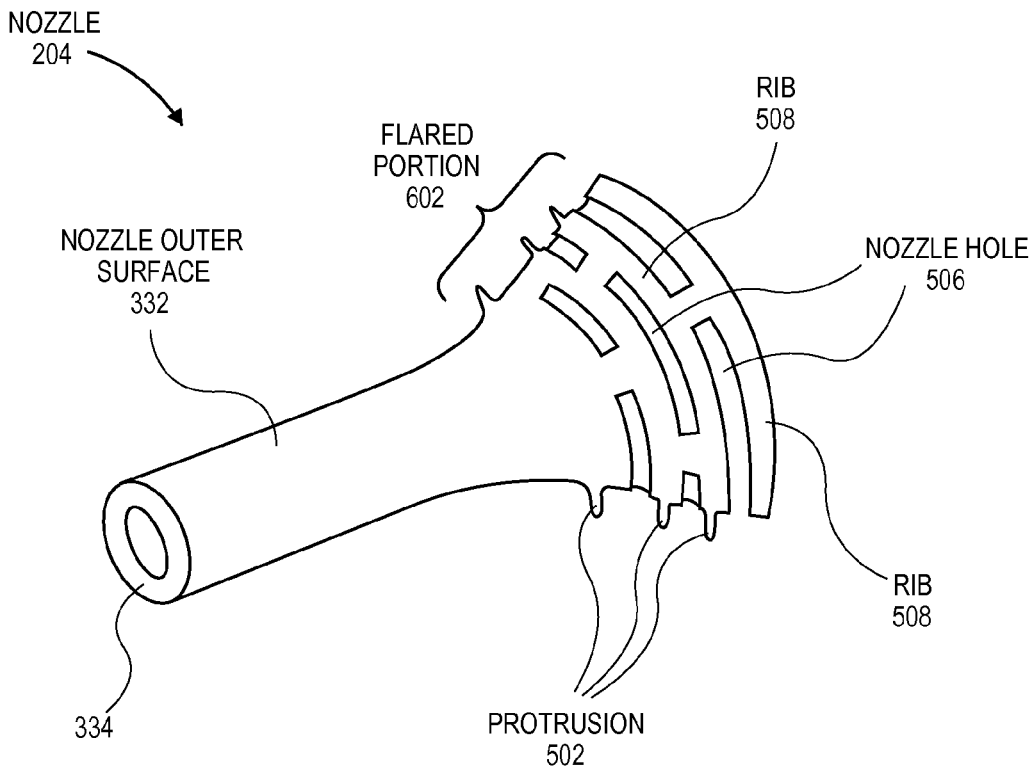
FIG. 6 is a perspective view of a nozzle of an intra-canal earphone in accordance with an embodiment of the invention.

Referring to FIG. 6, a perspective view of a nozzle of an intra-canal earphone is shown in accordance with an embodiment of the invention. In an embodiment, nozzle wall 334 spreads outward over a proximal region of nozzle 204. More particularly, nozzle outer surface 332 may have a generally conical shape along a flared portion 602. As shown in FIG. 5, the flared portion 602 may extend away from nozzle lumen 402 in the direction of a distal opening of housing 202. Resilient joint 350 may be overmolded on flared portion 602, and thus, flared portion 602 may provide some rigidity to earphone 108 along a tapered region between housing 202 and nozzle 204. Flared portion may incorporate one or more retention features, such as protrusions 502 similar to the projecting features described above. Furthermore, one or more nozzle holes 506 may be formed through nozzle wall 334 in the flared portion 602 to define one or more ribs 508. Accordingly, resilient joint 350 may be overmolded over flared portion 602 to overlay, fill, or otherwise grip one or more retention features of nozzle 204.

It will be appreciated that features similar to any of the retention features described above, such as holes 506, protrusions 502, lips 504, and ribs 508, may be formed in housing 202 or nozzle 204 to allow resilient joint 350 to overlay, fill, or otherwise grip and retain a component. Thus, housing 202 and nozzle 204 may be physically coupled by resilient joint 350 and the compliance and flexibility of elastomeric body 352 may allow for the retained housing 202 and nozzle 204 to pivot relative to each other.

Earphone 108 may be assembled or fabricated using numerous manufacturing methods. For example, in an embodiment, each component of earphone 108, e.g., driver 320, housing 202, resilient joint 350, and nozzle 204, may be formed separately using known molding, machining, or other fabrication techniques. The individually formed components may then be assembled, and optionally, bonded together. For example, housing 202 may be inserted over or into housing receptacle 356, nozzle 204 may be inserted over or into nozzle receptacle 354, and driver 320 may be inserted over or into driver receptacle 358. An adhesive or thermal bond may be formed between respective components using, e.g., chemical adhesives, welding processes including ultrasonic welding, etc., to enhance physical coupling between components. Sealants, such as gaskets, adhesives, lubricants, etc., may be applied between components to enhance acoustic coupling therebetween. In an embodiment, tip 206 may be located over nozzle 204. Thus, the individual components may be assembled to build earphone 108.

In an embodiment, one or more components may be integrally fabricated with one or more other components to build earphone 108. For example, one or more pieces may be molded, cast, machined, etc., and optionally assembled to form housing 202. The assembled housing 202 may include a hollow region within housing inner surface 302 to define chamber 404. Nozzle 204 may be similarly formed, e.g., by molding, casting, machining, etc., and a tubular nozzle wall 334 may be fabricated to form nozzle lumen 402 within nozzle inner surface 330. In an embodiment, housing 202 and nozzle 204 may be injection molded from a rigid polymer. After forming housing 202 and nozzle 204 separately, each of the parts may be located within a mold. The mold may be separate from the mold in which they were formed, or it may be the same mold in which they were formed. Resilient joint 350 may then be formed around the pre-fabricated housing 202 and nozzle 204, e.g., as a second shot within the same injection mold or as an overmold within a separate injection mold. In either case, at least a portion of resilient joint 350 may be flowed into the mold to overlay some portion of housing 202 and nozzle 204 surfaces, e.g., protrusions 502, and cooled to fill some portion of housing 202 and nozzle 204 features, e.g., chamber 404 or nozzle holes 506. Accordingly, a unified whole may be formed having an essentially solid region filled by some portion of housing 202, resilient joint 350, and nozzle 204 material. The monolithic subassembly of earphone 108 may further include receptacles, e.g., driver receptacle 358 and nozzle outer surface 332, to receive other components such as driver 320 and tip 206. Furthermore, as the overmolded material fills a portion of the mold around housing 202 and nozzle 204, joint lumen may be formed during or after the molding to provide a passage between chamber 404 and nozzle lumen 402. As described above, upon installation of driver 320 into driver receptacle 358, chamber 404 may become acoustically isolated from driver port 322 and nozzle lumen 402, while nozzle lumen 402 may become acoustically coupled with driver port 322.

Figure 7:
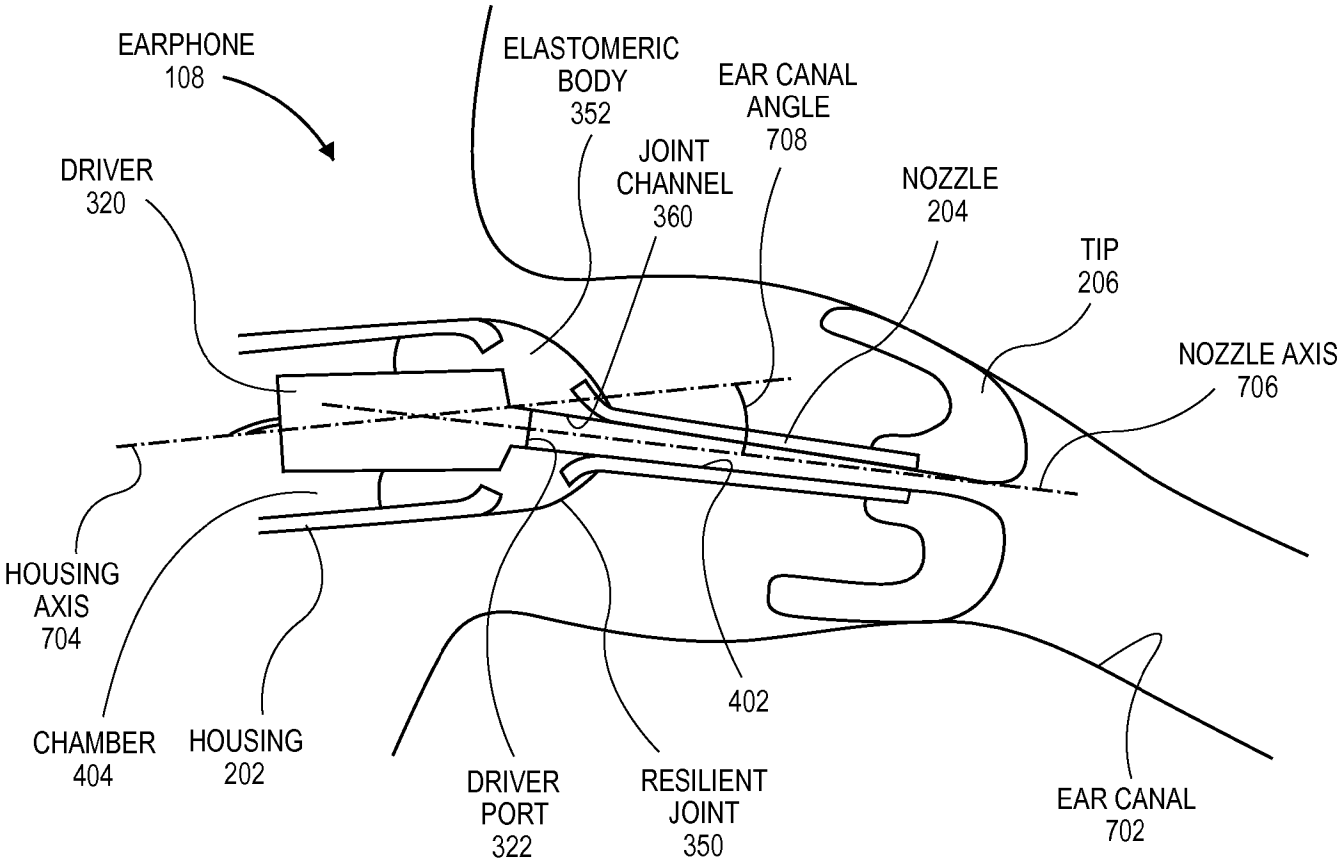
FIG. 7 is a pictorial view of an intra-canal earphone placed in an ear canal in accordance with an embodiment of the invention.

Turning now to FIG. 7, a pictorial view of an intra-canal earphone placed in an ear canal is shown in accordance with an embodiment of the invention. Assembled earphone 108 may be inserted into an ear canal 702. More particularly, tip 206 may be inserted within and sealed against ear canal 702, while housing 202 may remain substantially outside of the ear canal 702, e.g., within a concha of the user's ear. Furthermore, nozzle 204 may extend between housing 202 and tip 206, and thus, may occupy a portion of both the concha and ear canal 702. A housing axis 704 may pass through housing 202, e.g., through chamber 404 and a distal opening of housing 202, and define a direction distally away from housing 202. Similarly, a nozzle axis 706 may pass through nozzle 204, e.g., through nozzle lumen 402, and define a direction distally away from nozzle 204.

In an initial state, such as after assembly and prior to insertion into ear canal 702, housing axis 704 and nozzle axis 706 may be parallel and/or aligned with one another. After nozzle 204 is inserted into ear canal 702, lateral loading on tip 206 may be transmitted to nozzle 204, causing a bending moment about resilient joint 350 that results in deflection of elastomeric body 352. Flexing of elastomeric body 352 allows articulation between rigid housing 202 and rigid nozzle 204. More particularly, nozzle 204 may deflect to align with ear canal 702 while housing 202 may remain in an orientation that aligns with the concha or the outer region of ear canal 702. In a typical case where the ear canal 702 is angled, e.g., downward, from the concha, nozzle axis 706 may deflect away from the initial state. That is, nozzle axis 706 may deflect away from housing axis 704 by an ear canal angle 708. In an embodiment, articulation of nozzle 204 relative to housing 202 is facilitated by the flexibility of elastomeric body 352, which may allow nozzle axis 706 to pivot relative to housing axis 704 by at least 5-10 degrees. As described above, this articulation may depend on both the hardness and geometry of elastomeric body 352, which contributes to the overall system stiffness. Accordingly, earphone 108 may be comfortably fit into the user's ear, since the housing 202 may remain comfortably aligned with the concha of the ear while the nozzle 204 may angulate to conform to ear canal 702. Furthermore, since driver 320 may be cantilevered from joint channel 360, driver 320 may also experience some pivoting relative to housing 202 to maintain alignment with nozzle axis 706 and thus further enhance acoustic coupling between driver port 322 and nozzle lumen 402. Thus, an externally generated audio signal may be transmitted to driver 320 and converted to sound that is emitted from driver port 322 through joint channel 360 and nozzle lumen 402 into ear canal 702. Furthermore, leakage of sound into chamber 404 may be less likely since resilient joint 350 may both support driver 320 and seal against driver 320 to block sound from traveling between driver port 322 and chamber 404. Upon removal of earphone 108 from ear canal 702, elastomeric body 352 may apply a resilient force to cause nozzle 204 to pivot back toward the initial state and bring nozzle axis 706 back into alignment with housing axis 704.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An intra-canal earphone, comprising:

a housing having a chamber, wherein the housing is rigid;

a nozzle having a nozzle lumen, wherein the nozzle is rigid;

a driver located in the chamber and having a driver port, the driver being configured to receive an electrical audio signal and to emit sound from the driver port; and a resilient joint having an elastomeric body and a joint channel, wherein the nozzle is pivotally coupled with the housing through the elastomeric body, wherein the elastomeric body is elastomeric to allow the nozzle to pivot relative to the housing from an initial state when an external load is applied to the nozzle and to return to the initial state when the external load is removed, wherein the resilient joint is attached to a housing inner surface of the housing, wherein the resilient joint is attached to the nozzle, and wherein the nozzle lumen is acoustically coupled with the driver port through the joint channel.

2. The intra-canal earphone of claim 1, wherein the resilient joint fills a space between the housing inner surface and the nozzle.

3. The intra-canal earphone of claim 2, wherein the resilient joint is frictionally held by the housing inner surface, and wherein the nozzle is frictionally held by the resilient joint.

4. The intra-canal earphone of claim 3, wherein the housing includes a protrusion extending radially inward from the housing inner surface, and wherein the resilient joint covers the protrusion.

5. The intra-canal earphone of claim 3, wherein the nozzle includes one or more nozzle holes extending through a nozzle wall, and wherein the resilient joint fills the one or more nozzle holes.

6. The intra-canal earphone of claim 5, wherein the nozzle wall spreads outward along a flared portion of the nozzle from the nozzle lumen toward the housing, and wherein the one or more nozzle holes are located in the flared portion.

7. The intra-canal earphone of claim 6, wherein the one or more nozzle holes define a rib of the nozzle, and wherein the resilient joint surrounds at least a portion of the rib.

8. The intra-canal earphone of claim 1, wherein the resilient joint includes a driver receptacle, and wherein a driver outer surface of the driver is located within the driver receptacle.

9. The intra-canal earphone of claim 8, wherein the resilient joint seals against the driver outer surface at a proximal end of the joint channel and the resilient joint seals against the nozzle at a distal end of the joint channel such that the driver port is acoustically coupled with the nozzle lumen through the joint channel.

10. The intra-canal earphone of claim 9, wherein the resilient joint fills a space between a housing inner surface and the driver outer surface between the driver port and the chamber such that the driver port is acoustically isolated from the chamber.

11. The intra-canal earphone of claim 1, wherein the elastomeric body comprises a thermoplastic elastomer.

12. The intra-canal earphone of claim 11, wherein the driver includes a balanced armature transducer.

13. The intra-canal earphone of claim 12 further comprising a compliant tip having a tip lumen acoustically coupled with the driver port through the nozzle lumen, wherein a tip outer surface is configured to seal against an ear canal.

14. The intra-canal earphone of claim 13 further comprising:

an audio jack; and a cable electrically connected to the audio jack and to the driver, the cable being configured to transmit the electrical audio signal from the audio jack to the driver.

15. A method, comprising:

forming a housing having a chamber, wherein the housing is rigid;

forming a nozzle having a nozzle lumen, wherein the nozzle is rigid; and molding a resilient joint having an elastomeric body and a joint channel over at least a portion of the housing and the nozzle, such that the nozzle is pivotally coupled with the housing through the elastomeric body and the nozzle lumen is acoustically coupled with the chamber through the joint channel, wherein the resilient joint includes a driver receptacle in fluid communication with the joint channel; and installing a driver in the driver receptacle such that a driver port of the driver is acoustically coupled with the nozzle lumen through the joint channel.

16. The method of claim 15, wherein the resilient joint fills a portion of the chamber between a housing inner surface and a driver outer surface axially between the driver port and the chamber such that the driver port is acoustically isolated from the chamber.

17. The method of claim 16 further comprising disposing a compliant tip over a nozzle outer surface such that a tip lumen is acoustically coupled with the driver port through the nozzle lumen, wherein a tip outer surface is configured to seal against an ear canal.

18. An intra-canal earphone, comprising:

a housing having a chamber and a housing inner surface, wherein the housing is rigid;

a nozzle having a nozzle lumen, wherein the nozzle is rigid;

a driver located in the chamber and having a driver port, the driver being configured to receive an electrical audio signal and to emit sound from the driver port; and a resilient joint having an elastomeric body and a joint channel, wherein the nozzle is pivotally coupled with the housing through the elastomeric body, wherein the resilient joint fills a space between the housing inner surface and the nozzle, and wherein the nozzle lumen is acoustically coupled with the driver port through the joint channel.

19. The intra-canal earphone of claim 18, wherein the resilient joint includes a driver receptacle, and wherein a driver outer surface of the driver is located within the driver receptacle.

* * * * *